US005349572A

United States Patent [19]

Belik

[11] Patent Number: 5,349,572

[45] Date of Patent: Sep. 20, 1994

[54] CLOCK DIAL

[76] Inventor: Jaroslay Belik, 1610 Mulcahy, Rosenberg, Tex. 77471

[21] Appl. No.: 59,108

[22] Filed: May 10, 1993

[51] Int. Cl.[5] ..... G04B 19/04; G04B 19/20

[52] U.S. Cl. ..... 368/77; 368/80; 368/228; 368/233

[58] Field of Search ..... 368/76, 77, 80, 223, 368/228–234

[56] References Cited

U.S. PATENT DOCUMENTS

| | | | |
|---|---|---|---|
| 555,387 | 2/1896 | Long . | |
| 1,393,569 | 10/1921 | Richardson . | |
| 1,475,800 | 11/1923 | Creasy . | |
| 2,051,611 | 8/1936 | Liner . | |
| 2,266,183 | 12/1941 | Fergusson . | |
| 2,355,429 | 8/1944 | Fletcher . | |
| 2,728,187 | 12/1955 | Stamm | 58/59 |
| 3,672,149 | 6/1972 | Howard . | |
| 3,747,324 | 7/1973 | Foufounis | 58/126 R |
| 3,978,655 | 9/1976 | McGillick | 58/126 R |
| 4,428,682 | 1/1984 | Winter | 368/238 |
| 4,726,000 | 2/1988 | Weiss | 368/80 |
| 4,740,934 | 4/1988 | Noirjean | 368/77 |
| 4,885,731 | 12/1989 | Massaro | 368/228 |
| 4,991,154 | 2/1991 | Perucchi | 368/76 |
| 4,995,021 | 2/1991 | Sullivan | 368/233 |
| 5,051,968 | 9/1991 | Calabrese | 368/76 |

*Primary Examiner*—Vit W. Miska
*Attorney, Agent, or Firm*—Harrison & Egbert

[57] ABSTRACT

A clock dial having a minute face, an hour face with a smaller diameter than the minute face, and a minute hand rotatable relative to the minute face. The minute face has a central axis for rotating the minute hand. The hour face is geared relative to the central axis such that one revolution of the minute hand moves the hour face for less than one full revolution. The central axis has a first gear extending therearound. This first gear engages gear teeth formed on an outer edge of the hour face. A motor is connected to the central axis on a side of the minute face opposite the hour face. The hour face is geared to the minute hand such that one revolution of the minute hand moves the hour face approximately 1/12 of a revolution. The minute face has a set of indicia representative of minutes. The hour face has a set of indicia representative of hours.

13 Claims, 5 Drawing Sheets

CLOCK DIAL

TECHNICAL FIELD

The present invention relates to clocks and timepieces. More particularly, the present invention relates to a clock dial which has separate faces representative of hours and minutes.

BACKGROUND ART

A wide variety of clock mechanisms and clock dials exist in the prior art. Conventionally, clock dials include an hour face with minute indicia formed thereon. As the large minute hand sweeps around the face of the dial, a smaller hour hand moves gradually around the dial.

A wide variety of clock-type sculptures exist previously which represent time in a variety of ways. Often, such sculptures are very difficult to read and are generally unattractive. Various sculptures have utilized water, gears, balls, and tracks to properly indicate time. Although many clock sculptures are functional, they do not serve the purpose of both being attractive and functional.

Various U.S. patents have issued in the past which describe various types of clock mechanisms. U.S. Pat. No. 2,728,187, issued on Dec. 27, 1955, to H. Stamm, describes a watch with an indirectly driven minute hand. In this device, the amount of shake at the minute hand is reduced in such a way that such shake is not noticeable. This reduction of free play of the minute hand is obtained by providing a wheel on the cannon-pinion. The wheel is in meshing relationship with a pinion of the train of gear wheels of the watch. Both the sweep second and minute hands are driven directly.

U.S. Pat. No. 3,747,324, issued on Jul. 24, 1973, to J. Foufounis, describes a chronograph having a minute indicator member, a normal fixed dial which is graduated in minutes, two circular rotary elements which are coaxial with the indicator member. A minute graduation is retrogressive with respect to one of the elements while it is progressive with the other of the elements.

U.S. Pat. No. 3,978,655, issued on Sep. 7, 1976, to R. McGillick, shows a time clock having a revolving face dial. This time clock includes a housing, a watch movement, and a ternary of rotatable shafts cooperating with the watch movement. In this device, the second, minute and hour hands are fixed onto the free ends of the shafts. The second hand is integrally affixed onto the dial face thereby causing rotation of the dial face in union with the second hand through 360 degrees of every minute.

U.S. Pat. No. 4,428,682, issued on Jan. 31, 1984, to M. A. Winter, discloses a clock mechanism including a fixed ring defining an inner annular surface and an outer annular surface. An hour disk is disposed to roll against one of the surfaces so as to traverse the full annular extent thereof once every twelve hours. A minute disk is disclosed to roll against the other of the annular surfaces so as to traverse the full annular extent thereof once every hour. In the embodiment of the invention, the disks define planet gears, with the hour's planet gear being driven by an hour's sun gear so as to roll against the inner ring gear of the fixed ring. The minute's disk defines a planet gear driven by an outer ring gear to roll against the outer minute sun gear defined by the outer annular surface of the fixed ring. The fixed ring may be provided with suitable indicia to define a chapter ring.

U.S. Pat. No. 4,726,000, issued on Feb. 16, 1988, to R. Weiss, shows a timepiece having hour and minute hands of different configurations. These hour and minute hands are operated in a time-maintaining mode through the intermediary of a clockwork.

U.S. Pat. No. 4,885,731, issued on Dec. 5, 1989, to D. W. Massaro, teaches an annular timepiece face that contains a smaller hour portion concentrically positioned within a larger minute portion. The hour portion has an hour hand and hour division marks marking each interval of time on the peripheral hour track. The minute portion has a minute hand a minute division marks marking each interval of time on the peripheral minute track. The hour and minute hands are made to differ in spatial location, size, and color. In addition, correlated visible cues of spatial location, size, and color are used to specify the correspondence between the hour hand and the hour numerals and the minute hand and the minute numerals.

U.S. Pat. No. 4,995,021, issued on Feb. 19, 1991, to S. L. Sullivan, describes an improved clock display having a disk hour hand with an indicator being the minute hand which is located at a position remote for the access of the dial. The minute hand rotates on the hour disk. Time is determined by the relative position of the minute hand about the conventional time display (hours) and the position of the minute hand about its axis (minutes).

It is an object of the present invention to provide a clock dial that is attractive in appearance.

It is another object of the present invention to provide a clock dial that is relatively easy to read.

It is a further object of the present invention to provide a clock dial that operates simply and easily.

It is still a further object of the present invention to provide a clock dial that is relatively easy to manufacture and relatively inexpensive.

These and other objects and advantages of the present invention will become apparent from a reading of the attached specification and appended claims.

SUMMARY OF THE INVENTION

The present invention is a clock dial that comprises a minute face, an hour face having a smaller diameter than the minute face, and a minute hand which is rotatable relative to the minute face. The minute face has a central axis for rotating the minute hand. The hour face is geared relative to the central axis such that one revolution of the minute hand moves the hour face approximately one-twelfth of a revolution.

In the preferred embodiment of the present invention, the central axis has a first gear extending therearound. This first gear engages gear teeth formed on an outer edge of the hour face. The hour face has a center axis affixed to the minute face. The hour face is rotatable around this center axis.

In the first alternative embodiment of the present invention, the central axis has a first gear extending therearound. The first gear has external teeth. The hour face is an annular disk having internal teeth formed therein. The internal teeth engage the external teeth of the first gear. The hour face has twelve times the number of external teeth of the first gear. The minute hand is interposed between the hour face and the minute face. The first gear has a first flange surface extending outwardly at the external teeth at one end of the first gear. The first gear also has a second flange surface extending outwardly on an opposite side of the external teeth. The hour face has an edge which is interposed between the first and second flange surfaces.

In a second alternative embodiment of the present invention, the first gear has a pair of teeth rotatably positioned on opposite sides of the central axis. The hour face has twenty-four slotted internal teeth. The slotted internal teeth slidably engage the teeth of the first gear. Each of the pair of teeth has a generally X-shaped configuration. The slotted internal teeth are received centrally of this X-shaped configuration.

In a third alternative embodiment of the present invention, the minute hand has a pair of teeth extending outwardly therefrom. The hour face is an annular disk having a plurality of internal teeth formed therein. These internal teeth engage the pair of teeth of the minute hand. The pair of teeth are positioned distal the central axis such that the hour face will be positioned generally in offset relation to the center of the minute face. Specifically, the hour face has twenty-four internal teeth extending around an internal diameter. The hour face will have a center point of a constantly changing position as the minute hand rotates about the minute face.

In a fourth alternative embodiment of the present invention, the minute hand has a first gear affixed thereto. The hour face has an external gear extending around a circumference of the hour face. The external gear engages the first gear. The first gear is positioned on the minute hand distal the central axis. The hour face is supported freely from this first gear such that the hour face will appear in a generally offset position relative to the center of the minute face. The first gear has a hook extending outwardly therefrom. This hook engages an inner surface of the external gear. The hour face has a center point of constantly changing position as the minute hand rotates about the central axis. The minute hand is interposed between the hour face and the minute face.

In the present invention, a motor is connected to the central axis on a side of the minute face opposite the hour face. The motor serves to rotate the minute hand. The hour face is geared to the minute hand such that one revolution of the minute hand moves the hour face approximately thirty degrees. The minute face has a first set of indicia affixed to an outer surface. This first set of indicia is representative of minutes. The hour face has a second set of indicia affixed to an outer surface. This second set of indicia is representative of hours.

DETAILED DESCRIPTION OF THE INVENTION

Figure 1A:
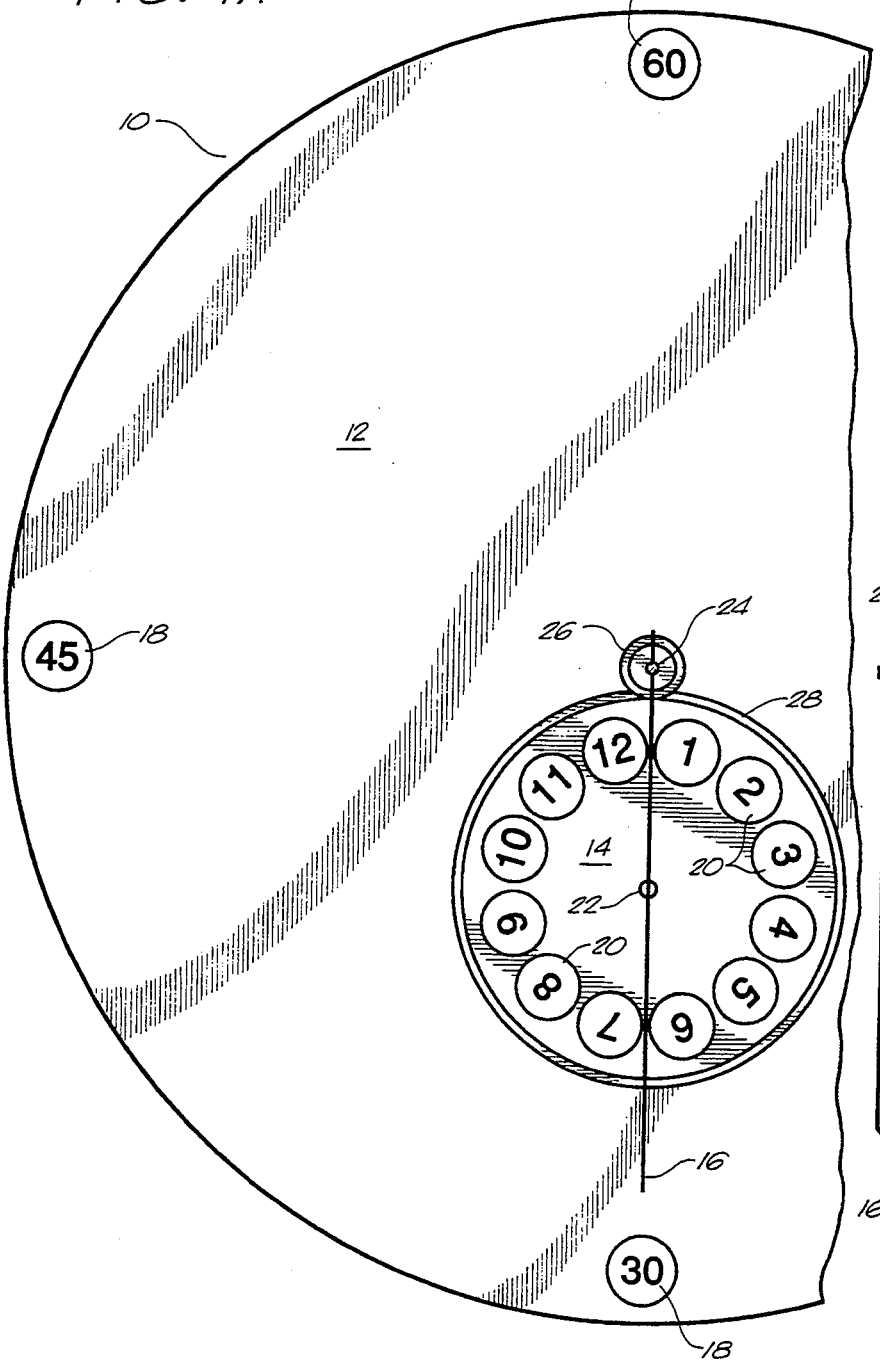
FIGS. 1A and B are frontal and cross-sectional views of the clock dial of the preferred embodiment of the present invention.

Referring to FIG. 1A, there is shown at 10 the clock dial in accordance with the preferred embodiment of the present invention. The clock dial 10 includes a minute face 12, an hour face 14, and a minute hand 16. As can be seen, the minute face 12 has a relatively large diameter. Indicia 18 are provided around the diameter of the minute face 12. The indicia 18 are indicative of minutes. The indicia 18 are, specifically, indicative of the number of minutes that have passed during a particular hour.

The hour face 14 has a smaller diameter than that of the minute face 12. The hour face 14 includes indicia 20 extending around the hour face 14. The indicia 20 are indicative of the number of hours. As can be seen, the hour face 14 is a disk-like member having a center point 22. The hour face 14 is rotatable about the center point 22.

The minute hand 16 is rotatable relative to the minute face 12. The minute face 12 includes a central axis 24 which is connected to the minute hand 16 for the purpose of rotating the minute hand. The central axis has a gear 26 connected thereto. The gear 26 will rotate in correspondence to the rotation of the minute hand 16 about the minute face 12. The gear 26 has external teeth which engage the external teeth 28 formed around the circumference of the hour face 14. As the minute hand 16 rotates, the gear 26 will rotate so as to correspondingly rotate the external gearing 28 of the hour face 14. As can be seen, a full rotation of the gear 26 will cause less than a full rotation of the external gear 28 of the hour face 14. Ideally, in the preferred embodiment of the present invention, a full rotation of the first gear 26 will cause the hour face 14 to rotate approximately one-twelfth of a revolution, or thirty degrees.

Figure 1B:
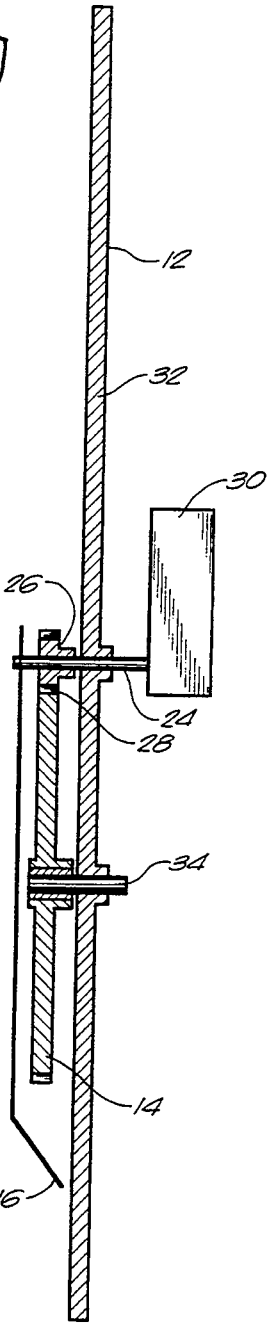

In FIG. 1B, it can be seen that a motor 30 is positioned on the back side 32 of the minute face 12. The motor 30 is connected to the central axis 24. As such, the motor 30 serves to drive the central axis 24. The central axis 24 is connected at one end to the minute hand 16. The central axis 24 is also connected to the first gear 26. The central axis 24 extends through the center of the minute face 12. The rotation of the central axis 24 serves to rotate the minute hand 16 of the minute face 12. Similarly, the rotation of the central axis 24 will cause the first gear 26 to rotate. The rotation of the first gear 26 will cause the external gear 28 of the hour face 14 to correspondingly rotate. The hour face 14 is supported on a center axis 34 affixed to the minute face 12. As such, in the preferred embodiment of the present invention, the hour face 14 will be affixed in its position relative to the minute face 12. The hour face 14 will rotate about the center axis 34. The hour face 14 is positioned in generally parallel relation to the minute face 12 and is positioned in overlying relationship thereto. The hour face 14 is interposed between the minute hand 16 and the minute face 12.

As can be seen in the preferred embodiment of the present invention, the present invention offers a novel technique for the display of time. As shown in FIG. 1A, the time, which is displayed, is 12:30. The minute hand 16 points to the thirty minute mark on the minute face 12. Since the uppermost point on the hour face 14 is between "twelve" and "one", then it is relatively easy to determine that the time which is displayed is 12:30. The minute hand 16 will rotate in a conventional fashion while the hour face rotates in a fixed position on the minute face 12.

Referring to FIG. 2, there is shown an alternative embodiment of the clock dial of the present invention. The clock dial 40 has a minute face 42, an hour face 44, and a minute hand 46. The hour face 44 has a configuration similar to that shown in FIG. 1A. The hour face 44 is an annular disk. The annular disk 44 has an open central area 48 formed therein. Internal teeth 50 extend around the interior diameter of the annular disk configuration of the hour face 44. These internal teeth 50 are received by teeth in a first gear 52. The first gear 52 is connected to the central axis of the minute face 42. This first gear 52 is also connected to the minute hand 46. As the minute hand 46 is rotated, the first gear 52 will rotate a corresponding amount. The first gear 52 has external teeth which mesh with the internal teeth 50 on the hour face 44. It can be seen that the minute hand 46 includes a portion 54 that can be displayed through the open interior 48 of the hour face 44. Hour indicia 56 extend around the hour face 44. The first gear 52 includes a first flange surface 58 that extends outwardly at the external teeth of the first gear 52. As can be seen, the first flange surface 58 extends upwardly over the internal teeth 50 of the hour face 44.

Figure 2A:
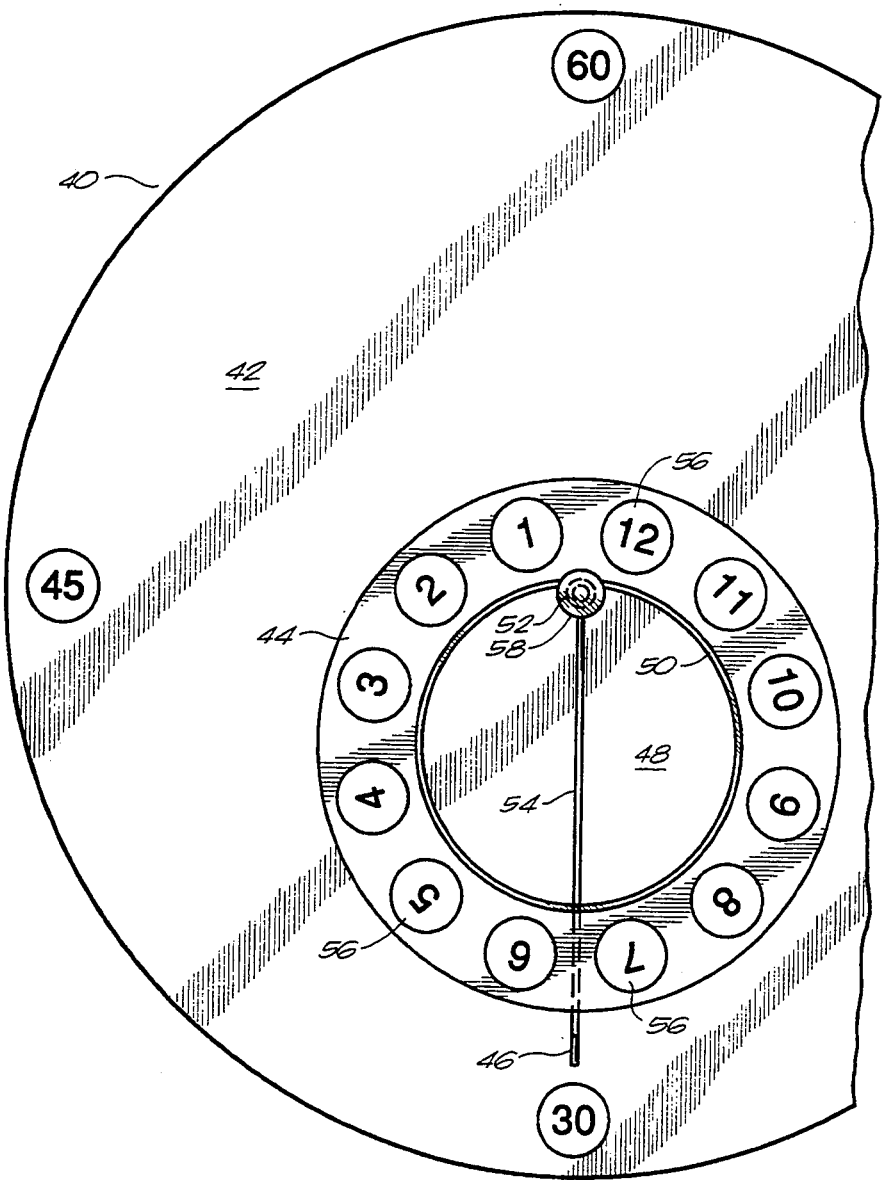
FIGS. 2A and B are frontal and cross-sectional views of a first alternative embodiment of the clock dial of the present invention.
Figure 2B:
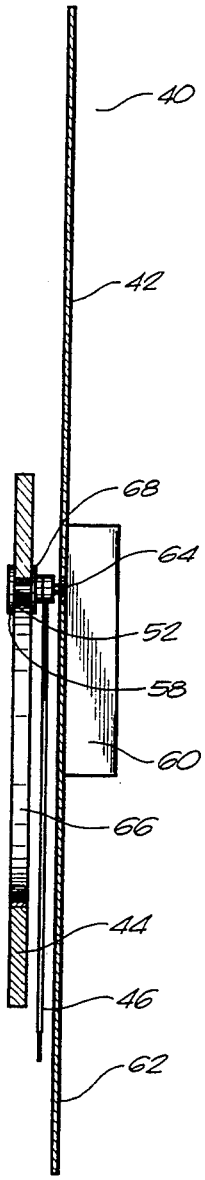

In FIG. 2B, the clock dial 40 is shown in cross section. The motor 60 is affixed to the back surface 62 of the minute face 42. The motor 60 is connected to the central axis 64. Central axis 64 is affixed to the minute hand 46 and to the first gear 52. As the central axis 64 is rotated by motor 60, the minute hand 46 will rotate a corresponding amount. Similarly, the first gear 52 will also rotate a corresponding amount. It can be seen that the first gear 52 includes a first flange surface 58 positioned on the outer surface 66 of the hour face 44. The first gear 52 includes a second flange surface 68 positioned on the opposite surface of the hour face 44. These flange surfaces 58 and 68 serve to receive an inner edge of the hour face 44 therein. As such, the hour face 44 will be properly retained as the hour face rotates relative to the movement of the first gear 52.

The first alternative embodiment 40 of the clock dial of the present invention presents another attractive technique for the display of time information. As the minute hand 46 rotates around the minute face 42, the hour face 44 will also rotate. The external teeth of the first gear 52 will have approximately one-twelfth the number of teeth of the internal gear 50 of the hour face 44. As such, during every revolution of the minute hand 46, the hour face 44 will rotate approximately thirty degrees. In this embodiment, the order of the indicia 56 of hours is reversed from that illustrated in FIG. 1A. This is necessary because of the internal gearing arrangement of the hour face 44. The time illustrated in FIG. 2A is 12:30. This is because the uppermost point of the hour face 44 is between the numeral "one" and the numeral "twelve". The minute hand 46 is pointing directly to the numeral "thirty" displayed on the minute face 42. The portion 54 of the minute hand 46 will provide interesting viewing as it passes through the open area 48 on the interior of the hour face 44.

Figure 3A:
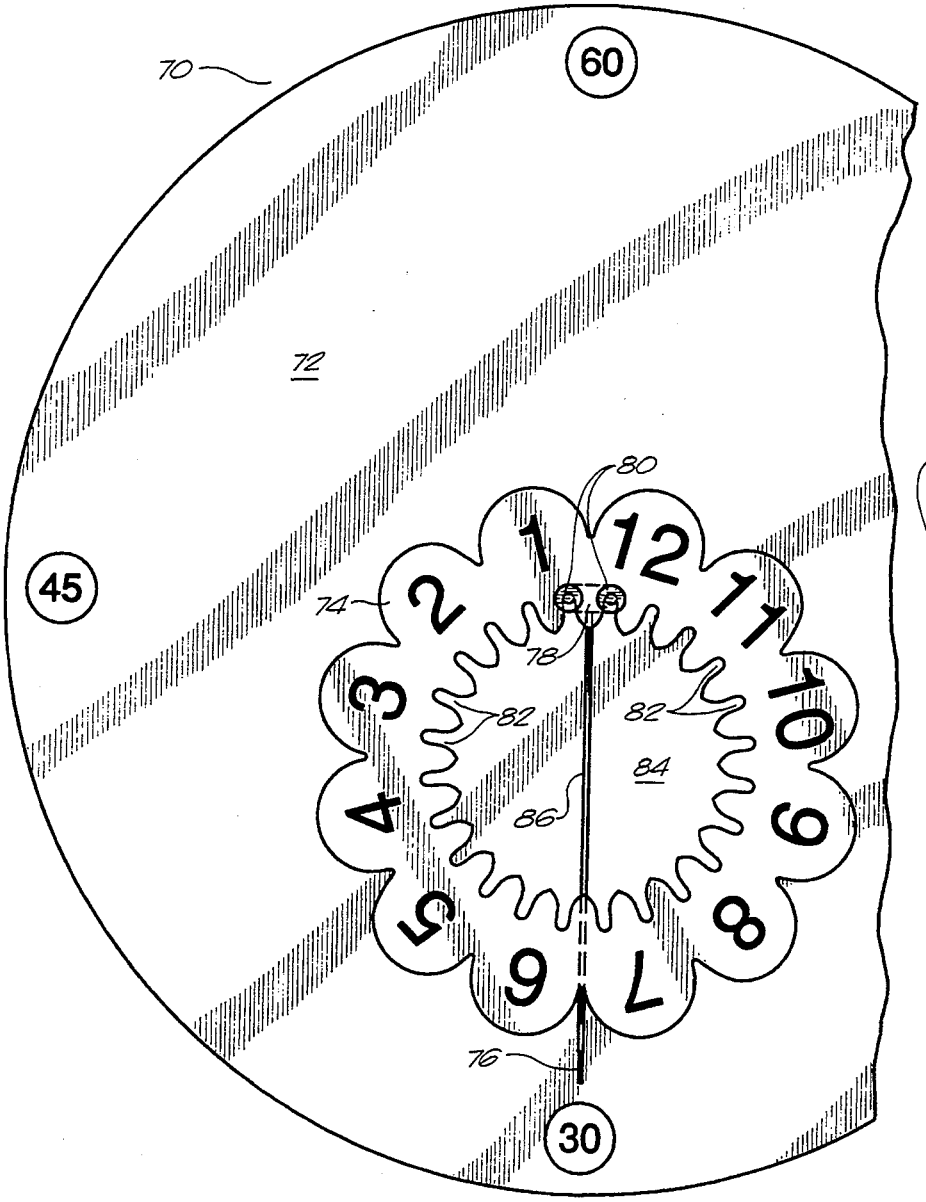
FIGS. 3A and B are frontal and cross-sectional views of a second alternative embodiment of the clock dial of the present invention.

FIGS. 3A and B show a second alternative embodiment 70 of the present invention. As with the previous embodiments, the clock dial 70 includes a minute face 72, an hour face 74, and a minute hand 76. The important difference in the clock dial 70 of the present invention is that the central axis 78 has a pair of gear teeth 80 rotatably positioned on opposite sides of the central axis 78. In simple terms, the multi-tooth configuration of the first gear 52 (of the embodiment illustrated in FIG. 2A) is replaced by a two-tooth gear 80. Similarly, the hour face 74 will have a plurality of slotted internal teeth 82. The slotted internal teeth 82 extend around the interior diameter of the hour face 74. As can be seen, each of the teeth 82 generally tapers outwardly from the interior of the hour face 74. The configuration of the slotted internal teeth 82 serves to "funnel" the teeth 80 thereinto. As the central axis 78 rotates, one of the two teeth 80 will rotate so as to move into position for engaging an internal tooth 82 adjacent thereto. The hour face 74 includes an open internal area 84 through which the interior portion 86 of the minute hand 76 can be seen. The outer diameter of the hour face 74 has a pleasing tabbed design for the display of the numerals.

Figure 3B:
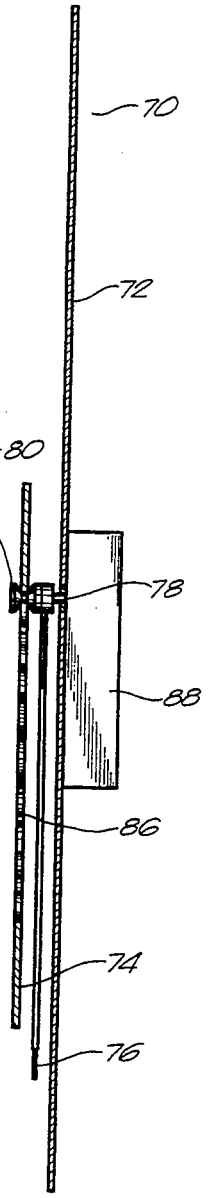

In FIG. 3B, it can be seen that the motor 88 is affixed to the back surface of the minute face 72. The central axis 78 extends through the minute face 72 and is affixed to the minute hand 76 and to the teeth 80. Each of the teeth 80 has a generally X-shaped configuration. The hour face 74 has an interior edge that is received centrally of this X-shaped configuration. The X-shaped configuration serves to prevent the hour face 74 from sliding off of the gear teeth 80. A rotation of the central axis 78 will rotate the minute hand 76 in a conventional fashion. Similarly, the teeth 80 will also rotate so as to move and engage the internal slotted teeth 82 of the hour face 74.

A total of twenty-four internal slotted teeth 82 are provided on the inner diameter of the hour face 74. Since two teeth 80 are provided on the central axis 78, the minute hand 76 will still have a 1:12 ratio of teeth with the hour face 74.

Figure 4A:
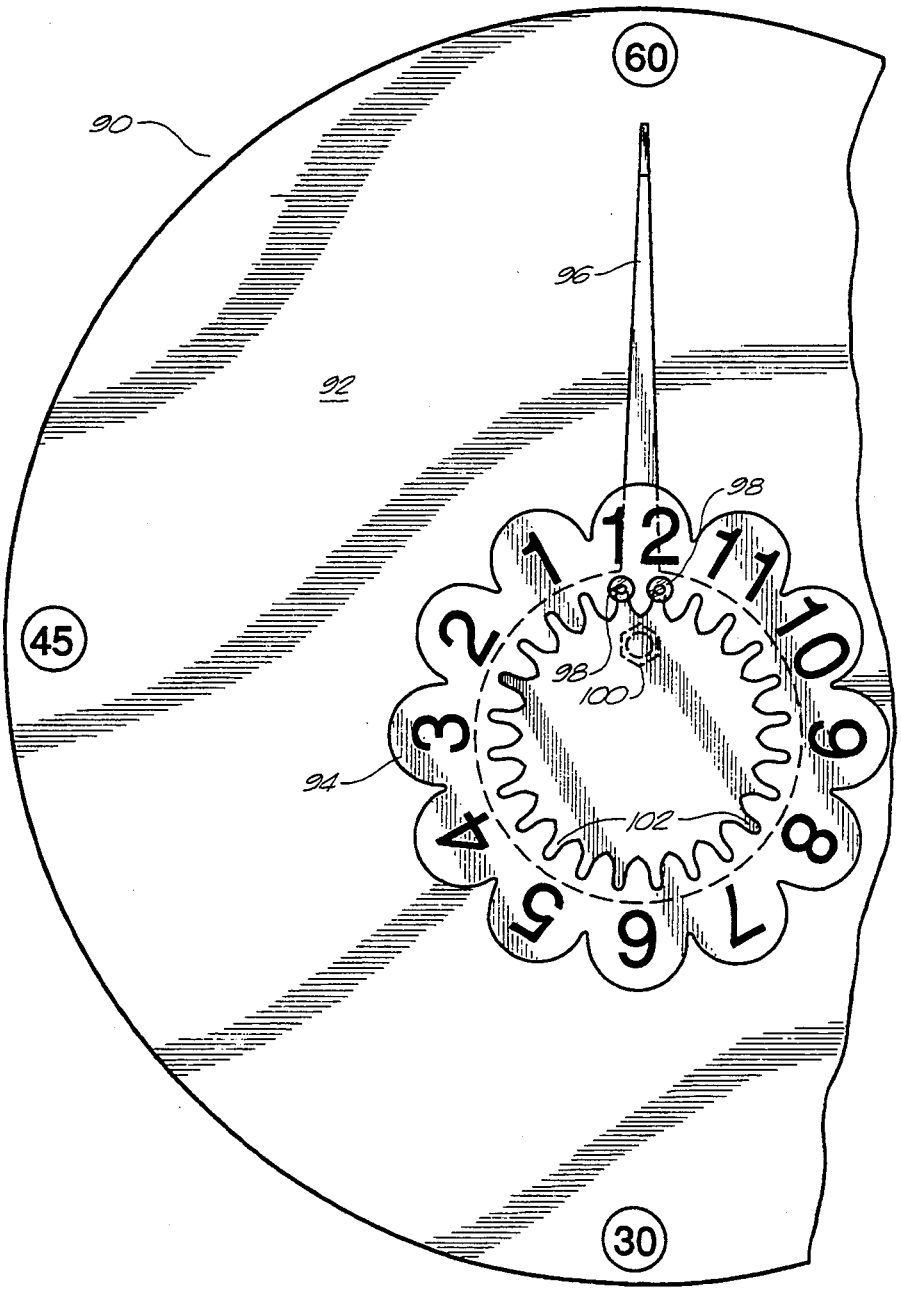
FIGS. 4A and B are frontal and cross-sectional views of a third alternative embodiment of the clock dial of the present invention.

FIG. 4A shows a third alternative of the clock dial 90 of the present invention. The clock dial 90 includes a minute face 92, an hour face 94, and a minute hand 96. The clock dial 90 of the present invention has a configuration similar to that described herein previously in conjunction with FIGS. 3A and B. The major difference between the clock dial 90 and that of the previous embodiment is that the pair of gear teeth 98 are affixed to the minute hand 96, rather than on the central axis 100. The hour face 94 has a configuration similar to that of clock dial 74 of FIGS. 3A and 3B.

The minute hand 96 has a generally widened surface adjacent to the central axis 100. The pair of gear teeth 98 are positioned on this widened surface of the minute hand 96. The pair of gear teeth 98 will engage the internal slotted teeth 102 of the hour face 94. As the minute hand 96 rotates relative to the minute face 92, the gear teeth 98 will slowly move from the position illustrated in FIG. 4A to a position in which one of the teeth 98 will engage another of the slots 102. In general, the configuration of FIG. 4A provides that the hour face 94 will be in a generally offset relationship to that of the central axis 100 on the minute face 92. In general, the center point of the hour face 94 will constantly change its position relative to the minute face 92 as the minute hand 96 moves around the minute face 92.

Figure 4B:
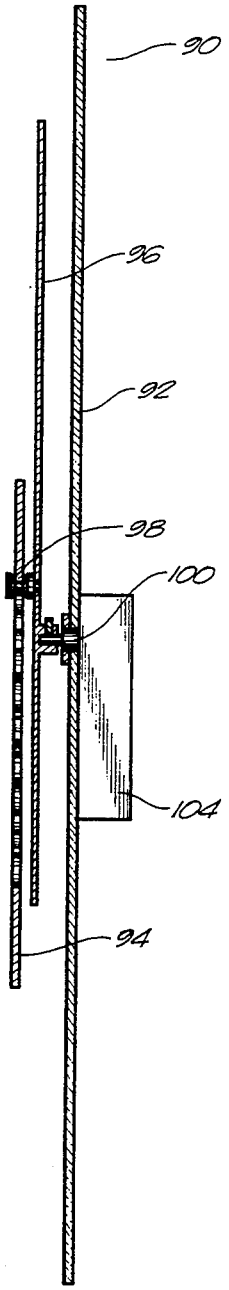

FIG. 4B shows that a motor 104 is affixed to the back surface of the minute face 92. The motor 104 serves to drive the central axis 100. As can be seen, the central axis 100 is connected to the minute hand 96 so as to cause the minute hand 96 to rotate around the minute face 92. The gear teeth 98 are affixed to an outer surface of the minute hand 96. It can be seen that the gear teeth 98 are in an offset position relative to the central axis 100. The gear teeth 98 have a generally X-shaped cross section so as to receive an interior edge of the hour face 94. Since the gear teeth 98 are distal the central axis 100, the hour face 94 will be displayed in a rather offset relationship to the central axis 100. This will present a new and unusual appearance to the clock face of the present invention.

Figure 5A:
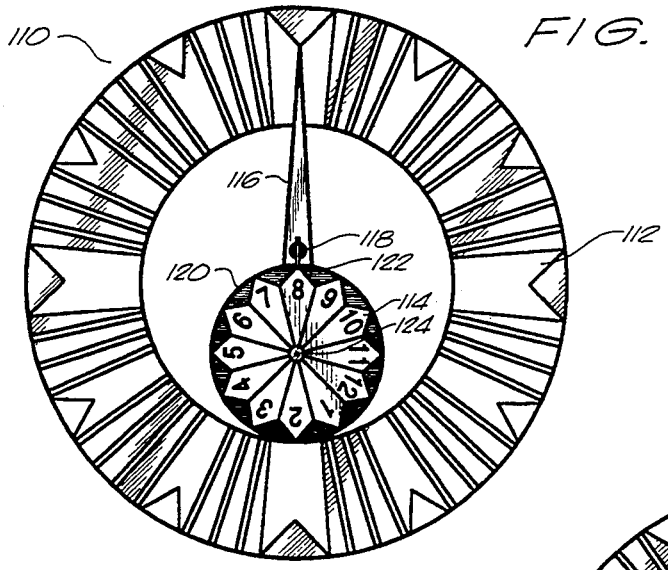
FIGS. 5A–C are frontal views of a fourth alternative embodiment of the present invention showing the manner of movement of the hour face with respect to the minute face during the movement of the minute hand.

FIG. 5A illustrates a fourth alternative embodiment of the clock dial 110 of the present invention. As with the previous embodiment, the clock dial 110 includes a minute face 112, an hour face 114, and a minute hand 116. The minute hand 116 has a first gear 118 affixed to a surface thereof. The gear 118 is offset from the central axis of the minute face 112. The hour face 114 has an external gear 120 extending around a circumference of the hour face 114. The external gear 120 engages the teeth of the first gear 118. It can be seen that the hour face 114 is supported freely from the first gear 118 on the minute hand 116. A hook 122 is provided on the first gear 118 and extends outwardly therefrom. This hook 122 engages an inner surface of the external gear 120.

During the rotation of the minute hand 116, the hour face 114 will have a center point 124 which is of constantly changing position relative to the central axis of the minute face 112. It can be seen that the minute hand 116 is interposed between the hour face 114 and the minute face 112.

In FIG. 5A, it can be seen that the minute hand is pointing to the uppermost or "zero" position on the minute face 112. Similarly, the hook 122 points to the numeral "eight" on the hour face 114. As such, the clock dial 110 illustrates the time 8:00. The minute indicia on the minute face 112 has a stylized configuration. The hour indicia on the hour face 114 is represented by numerals and displayed in an attractive fashion.

Figure 5B:
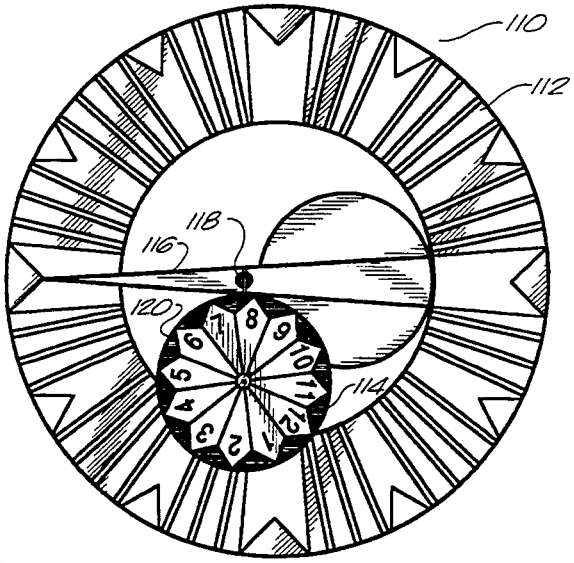

In FIG. 5B, it can be seen that the minute hand 116 is directed toward the left. The hook 122 is directed to the area between the numeral "seven" and the numeral "eight". As such, the time displayed on the clock dial 110 is 7:45. Since the hour face 114 is supported freely on the first gear 118, the hour face 114 is shown in a rather offset position relative to the center of the minute face 112. As the minute hand 116 rotates, the first gear 118 will correspondingly cause the hour face 114 to rotate.

Figure 5C:
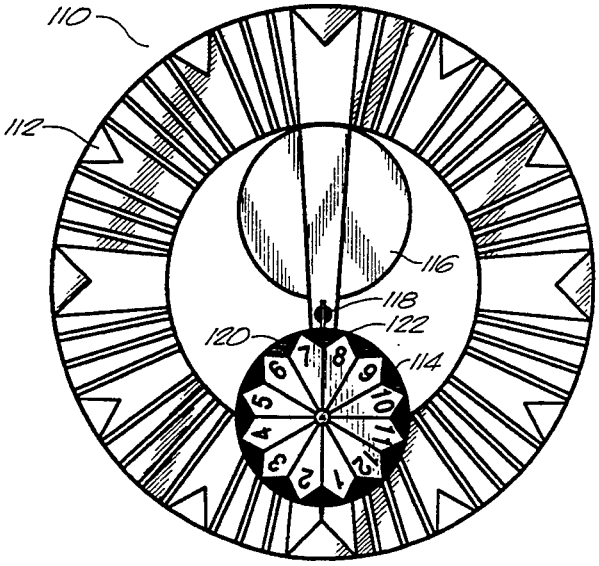

FIG. 5C shows the minute hand 116 pointing downwardly to the lowermost position on the minute face 112. The hour face 114 has been rotated so that the hook 122 points toward the area between the numeral "seven" and the numeral "eight". As such, the clock dial 110 illustrates the time as 7:30. It can be seen further that the hour face 114 hangs freely relative to the first gear 118. The hook 122 serves to support the first gear 118 in juxtaposition with the external gear 120 of the hour face 114.

The present invention offers various embodiments of a clock dial having aesthetically pleasing characteristics. Additionally, the clock dial of the various embodiments of the present invention is relatively easy to read. Since the minute hand is in a proper geared relationship to the hour face, an accurate display of time is assured.

The foregoing disclosure and description of the invention is illustrative and explanatory thereof. Various changes in the illustrated configuration may be made within the scope of the appended claims without departing from the true spirit of the invention. The present invention should only be limited by the following claims and their legal equivalents.

I claim:

1. A clock dial comprising:
minute face;
an hour face having a smaller diameter than said minute face; and
a minute hand rotatable relative to said minute face, said minute face having a central axis for rotating said minute hand, said hour face geared relative to said central axis such that one revolution of said minute hand moves said hour face for less than a full revolution, said central axis having a first gear extending therearound, said first gear having external teeth, said hour face being an annular disk, said annular disk having internal teeth formed therein, said internal teeth engaging said external teeth of said first gear.

2. The clock dial of claim 1, said hour face having twelve times the number of external teeth of said first gear, said minute hand interposed between said hour face and said minute face.

3. The clock dial of claim 1, said first gear having a first flange surface extending outwardly of said external teeth at one end of said first gear, said first gear having a second flange surface extending outwardly on an opposite side of said external teeth, said hour face having an edge interposed between said first and second flange surfaces.

4. The clock dial of claim 1, said first gear having a pair of teeth rotatably positioned on opposite sides of said central axis, said hour face having at least twelve slotted internal teeth, said slotted internal teeth slidably engaging said teeth of said first gear.

5. The clock dial of claim 4, each of said pair of teeth having a generally X-shaped configuration, said slotted internal teeth received centrally of said X-shaped configuration.

6. A clock dial comprising:
minute face;
an hour face having a smaller diameter than said minute face; and
a minute hand rotatable relative to said minute face, said minute face having a central axis for rotating said minute hand, said hour face geared relative to said central axis such that one revolution of said minute hand moves said hour face for less than a full revolution, said minute hand having a pair of teeth extending outwardly from a surface thereof, said hour face being an annular disk having a plurality of internal teeth formed therein, said internal teeth engaging said pair of teeth of said minute hand.

7. The clock dial of claim 6, said pair of teeth positioned distal said central axis.

8. The clock dial of claim 7, said hour face having twenty-four internal teeth extending around an internal diameter, said hour face having a center point of a constantly changing position as said minute hand rotates about said minute face.

9. A clock dial comprising:
minute face;
an hour face having a smaller diameter than said minute face; and
a minute hand rotatable relative to said minute face, said minute face having a central axis for rotating said minute hand, said hour face geared relative to said central axis such that one revolution of said minute hand moves said hour face for less than a full revolution, said minute hand having a first gear affixed thereto, said hour face having an external gear extending around a circumference of said hour face, said external gear engaging said first gear, said first gear positioned on said minute hand distal said central axis, said hour face supported freely from said first gear, said first gear having a hook extending outwardly therefrom, said hook engaging an inner surface of said external gear, said hour face having a center point of constantly changing position as said minute hand rotates about said central axis.

10. The clock dial of claim 9, said minute hand interposed between said hour face and said minute face.

11. The clock dial of claim 1, further comprising: a motor connected to said central axis on a side of said minute face opposite said hour face, said motor for rotating said minute hand.

12. The clock dial of claim 1, said hour face geared to said minute hand such that one revolution of said minute hand moves said hour face one-twelfth of a revolution.

13. The clock dial of claim 1, said minute face having a first set of indicia affixed to an outer surface, said first set of indicia representative of minutes, said hour face having a second set of indicia affixed to an outer surface, said second set of indicia representative of hours.

* * * * *